US006858992B2

(12) United States Patent
Park et al.

(10) Patent No.: US 6,858,992 B2
(45) Date of Patent: Feb. 22, 2005

(54) ORGANIC ELECTRO-LUMINESCENCE DEVICE AND METHOD AND APPARATUS FOR DRIVING THE SAME

(75) Inventors: Jae Yong Park, Kyounggi-do (KR); Joon Kyu Park, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/608,493

(22) Filed: Jun. 30, 2003

(65) Prior Publication Data

US 2004/0041525 A1 Mar. 4, 2004

(30) Foreign Application Priority Data

Aug. 27, 2002 (KR) ..... 10-2002-0050879

(51) Int. Cl.[7] ..... G09G 3/10
(52) U.S. Cl. ..... 315/169.3; 345/211; 345/76
(58) Field of Search ..... 315/169.1, 169.3; 345/204, 211, 55, 76–80

(56) References Cited

U.S. PATENT DOCUMENTS 6,271,812 B1 * 8/2001 Osada et al. ..... 345/76
6,448,718 B1 * 9/2002 Battersby ..... 315/169.3
6,731,276 B1 * 5/2004 Ishizuka ..... 345/211
2002/0195964 A1 * 12/2002 Yumoto ..... 315/169.3
2003/0001828 A1 * 1/2003 Asano ..... 345/204

FOREIGN PATENT DOCUMENTS

JP 2000-268957 A 9/2000
KR 2002-0029317 A 4/2002

* cited by examiner

*Primary Examiner*—Thuy Vinh Tran
(74) *Attorney, Agent, or Firm*—Birch, Stewart, Kolasch & Birch, LLP

(57) ABSTRACT

The present invention is directed to an organic electro-luminescence device that is adaptive for improving the reliability of an electro-luminescence cell, and a method and apparatus for driving the same. An organic electro-luminescence device according to an embodiment of the present invention includes a plurality of column lines supplied with data; a plurality of row lines crossing the column lines for selecting a scan line; an electro-luminescence cell formed at each pixel area between the column lines and the row lines; and a cell drive voltage source for applying a drive voltage to the electro-luminescence cell, and wherein a cathode terminal of the electro-luminescence cell is selectively connected to a common voltage source and a ground voltage source to have a reverse bias voltage applied.

22 Claims, 11 Drawing Sheets

ORGANIC ELECTRO-LUMINESCENCE DEVICE AND METHOD AND APPARATUS FOR DRIVING THE SAME

The present application claims, under 35 U.S.C. § 119, the priority benefit of Korean Patent Application No. P2002-50879 filed Aug. 27, 2002, the entire contents of which are herein fully incorporated by reference.

BACKGROUND OF THE INVENTION

1. Field of the Invention

The present invention relates to an organic electro-luminescence device, and more particularly to an organic electro-luminescence device that is adaptive for improving the reliability of an electro-luminescence cell, and a method and apparatus for driving the same.

2. Description of the Related Art

Recently, there have been developed various flat display devices, which can be reduced in weight and bulk where a cathode ray tube CRT has a disadvantage. Such flat display panel includes a liquid crystal display LCD, a field emission display FED, a plasma display panel PDP, and an electro-luminescence (EL) display device.

The structure and fabricating process of the PDP among these are relatively simple. A PDP is advantageous to be made light, thin and large-sized, but the light emission efficiency and brightness thereof is low and its power dissipation is high. It is difficult to make an active matrix LCD (where a thin film transistor TFT is used as a switching device) large-sized because of using a semiconductor process, but since it is mainly used as a display device of a notebook computer, the demand for it is increasing.

As compared with this, the EL device is generally classified into an inorganic EL device and an organic EL device in accordance with the material of a light-emission layer. The EL device being a self-luminous device has an advantage that its response speed is fast, its light-emission efficiency and brightness are high, and it has a wide viewing angle.

The organic EL device, as shown in FIG. 1, has an anode electrode 2 formed of a transparent electrode pattern on the glass substrate 1. There are deposited a hole injection layer 3, a light emission layer 4, an electron injection layer 5 on top of the anode electrode 2. There is formed a cathode electrode 6 of metal electrode on the electron injection layer 5.

If a drive voltage is applied to the anode electrode 2 and the cathode electrode 6, holes in the hole injection layer 3 and electrons in the electron injection layer 5 each progress toward the light emission layer 4 to excite the light emission layer 4, so the light emission layer 4 is caused to emit visible ray. In this way, a picture or an image is displayed with the visible ray emitted from the light emission layer 4.

Referring to FIG. 2, the organic electro-luminescence device includes m number of column lines CL1 to CLm, n number of row lines RL1 to RLn, and m×n number of pixels Pixels (7) arranged in a matrix having the column lines CL1 to CLm cross the row lines RL1 to RLn.

FIG. 3 shows a circuit diagram of each pixel 7 in the device of FIG. 2. As shown in FIG. 3, the organic EL device includes a first TFT T1 formed at each intersection area of the column lines CL1 to CLm and the row lines RL1 to RLn to act as a switching device, a second TFT T2 formed between a corresponding cell drive voltage source VDD and a corresponding electro-luminescence cell OELD for driving the corresponding electro-luminescence cell OELD, and a capacitor Cst connected between the first and second TFT's T1 and T2. The first and second TFT's T1 and T2 are p-type MOS-FETs.

The first TFT T1 is turned on in response to a negative scan voltage from a corresponding one of the row lines RL1 to RLn to make a current path conduct electricity between the source terminal and the drain terminal of itself, and is sustained at an off-state when the voltage in the corresponding one of the row lines RL1 to RLn is lower than its threshold voltage Vth. While the first TFT T1 remains at its on-state, the data voltage $V_{CL}$ from a corresponding column line CL is applied to the gate terminal of the second TFT T2 through the source terminal and the gate terminal of the first TFT T1. Contrary to this, the current path between the source terminal and the drain terminal of the first TFT T1 is open during the off period of the first TFT T1, so the data voltage $V_{CL}$ is not applied to the second TFT T2.

The second TFT T2 controls the current between the source terminal and the drain terminal in accordance with the data voltage $V_{CL}$ applied to the gate terminal of itself to cause the electro-luminescence cell OLED to emit light in a brightness corresponding to the data voltage $V_{CL}$.

The capacitor Cst stores a difference voltage between the data voltage $V_{CL}$ and the cell drive voltage VDD to cause the voltage applied to the gate terminal of the second TFT T2 to be sustained uniformly for one frame period and at the same time to sustain the current applied to the electro-luminescence OLED uniformly for one frame period.

FIG. 4 represents a scan voltage and a data voltage applied to the organic electro-luminescence device shown in FIG. 2.

Referring to FIG. 4, the row lines RL1 to RLn are sequentially supplied with negative scan pulses SCAN, and the column lines CL1 to CLm are simultaneously supplied with data voltages DATA synchronized with the scan pulses SCAN. Because of this, the data voltage DATA flows through the first TFT T1, and the data voltages are charged in the capacitor Cst.

Further, in such a structure, there is required a number of column lines as many as pixel signals of RGB are inputted.

FIG. 5 is another equivalent circuit diagram of a pixel which may be used for each pixel 7 in the organic electro-luminescence device shown in FIG. 2.

Referring to FIGS. 2 and 5, the organic electro-luminescence device includes m number of column lines CL1 to CLm, n number of row lines RL1 to RLn, and m×n number of pixels Pixels (7) arranged in a matrix having the column lines CL1 to CLm cross the row lines RL1 to RLn.

Further, for each pixel 7, in this example, the organic EL device includes a first TFT T11 formed between the cell drive voltage source VDD and the electro-luminescence cell OLED to drive the electro-luminescence cell OLED; a second TFT T12 connected to the cell drive voltage source VDD to form a current mirror with the first TFT T11; a third TFT T13 connected to the second TFT T12, the corresponding column line CL and the corresponding row line RL to respond to the signal in the corresponding row line RL; a fourth TFT T14 connected between the gate terminals of the first TFT T11 and the second TFT T12, the row line RL and the third TFT T13; and a capacitor Cst connected between the gate terminals of the first TFT T11 and the second TFT T12 and the voltage supply line VDD. The first to fourth TFT's T11 to T14 are p-type MOS-FETs.

The third and fourth TFT's T13 and T14 are turned on in response to a negative scan voltage from the row line RL to make a current path conduct electricity between their source terminal and the drain terminal, and are sustained at an off-state when the voltage in the row line RL is lower than their threshold voltage Vth. While the third and fourth TFT's T13 and T14 remain at their on-state, the data voltage $V_{CL}$ from the corresponding column line CL is applied to the gate terminal of the first TFT T11 through the third and fourth TFT's T13 and T14. Contrary to this, the current paths between the source terminal and the drain terminal of the first and second TFT's T11 and T12 are open during the off-period of the first and second TFT's T11 and T12, so the data voltage $V_{CL}$ is not applied to the first TFT T11.

The first TFT T11 controls the current between its source and drain terminals in accordance with the data voltage $V_{CL}$ applied to its gate terminal to cause the electro-luminescence cell OLED to emit light in a brightness corresponding to the data voltage $V_{CL}$.

The second TFT T12 is configured in a current mirror form with the first TFT T11 to control the current from the first TFT T11 uniformly.

The capacitor Cst stores a difference voltage between the data voltage $V_{CL}$ and the cell drive voltage VDD to cause the voltage applied to the gate terminal of the first TFT T11 to be sustained uniformly for one frame period and at the same time to sustain the current applied to the electro-luminescence OLED uniformly for one frame period.

FIG. 6 represents a scan voltage and a data voltage applied to the electro-luminescence device shown in FIG. 5.

Referring to FIG. 6, negative scan pulses SCAN are sequentially applied to the row lines RL1 to RLn and data voltages DATA synchronized with the scan pulses SCAN are simultaneously applied to the column lines CL1 to CLn. Because of this, the data voltages DATA are charged in the capacitor Cst through the third and fourth TFT's T13 and T14. The data voltage DATA charged in the capacitor Cst is held for one frame period, and then controls the current path of the first TFT T11. Further, in such a structure, there is required a number of column lines as many as pixel signals of RGB are inputted.

In the circuit diagrams as above, in case of FIG. 3, the second TFT T2 is driven by the cell drive voltage VDD, i.e., DC voltage, while the electro-luminescence cell OLED is turned on, differently from the first TFT T11. Further, in case of FIG. 5, the first TFT T11 is driven by the cell drive voltage VDD, i.e., DC voltage, while the electro-luminescence cell OLED is turned on, differently from the third and fourth TFT's T13 and T14.

As described above, the electro-luminescence cell OLED of the organic electro-luminescence device according to the related art is always connected to the ground GND. Thus the electro-luminescence cell OLED is driven only in a forward direction. Due to this limitation, residual currents (e.g., status charges) are accumulated within the electro-luminescence cell OLED when being driven for a long time. Such residential currents interference with the recombination process of the holes with the electrons in the light emission layer 4, whereby the lifetime, reliability and effectiveness of the organic EL device are significantly reduced.

SUMMARY OF THE INVENTION

Accordingly, it is an object of the present invention to provide an organic electro-luminescence device that is adaptive for improving the reliability of an electro-luminescence cell, and a method and apparatus for driving the same.

It is another object of the present invention to provide an organic EL device and a method and apparatus for driving the EL device, which overcome problems and limitations of the related art.

In order to achieve these and other objects of the invention, an organic electro-luminescence device according to an aspect of the present invention includes a plurality of column lines supplied with data; a plurality of row lines crossing the column lines for selecting a scan line; an electro-luminescence cell formed at each pixel area between the column lines and the row lines; and a cell drive voltage source for applying a drive voltage to the electro-luminescence cell, wherein a cathode terminal of the electro-luminescence cell is selectively connected to a common voltage source and a ground voltage source to have a reverse bias voltage applied.

The organic electro-luminescence device further includes a switch selectively connecting the cathode terminal of the electro-luminescence cell to either the common voltage source or the ground voltage source.

In one example, the switch is switched between the common voltage source terminal and the ground voltage source terminal by a designated period, e.g., for one frame. In another example, the switch is switched to each terminal for each ½ frame period. In still another example, the switch is switched to each terminal by the asymmetric period for one frame.

In accordance with one embodiment of the present invention, organic electro-luminescence device includes a first switching device formed at each intersection area of the column lines and the row lines; a second switching device formed between the electro-luminescence cell and the cell driver voltage source for driving the electro-luminescence cell; and a capacitor connected between the first and second switching devices and the cell drive voltage source.

Here, a common voltage applied from the common voltage source is set to be higher than a total voltage obtained by adding a threshold voltage of the electro-luminescence cell after subtracting a threshold voltage of the second switching device from the cell drive voltage.

In one example, the first and second switching devices are thin film transistors. In another example, the first and second switching devices are MOS TFT's. In still another example, the first and second switching devices are either n-type MOS TFT's or p-type MOS TFT's.

In accordance with another embodiment of the present invention, the organic electro-luminescence device includes a first switching device formed at each intersection area of the column lines and the row lines and connected between the cell drive voltage source and the electro-luminescence cell; a second switching device forming a current mirror with the first switching device and connected to the cell driver voltage source; a third switching device connected to the second switching device, the column line and the row line for responding to a data signal in the row line; a fourth switching device connected to the second and third switching devices and the row line; and a capacitor connected between the first and second switching devices and the cell drive voltage source.

Here, a common voltage applied from the common voltage source is set to be higher than a total voltage obtained by adding a threshold voltage of the electro-luminescence cell after subtracting a threshold voltage of the second switching device from the cell drive voltage.

In one example, the first to fourth switching devices are thin film transistors. In another example, the first to fourth switching devices are MOS TFT's. In still another example, the first to fourth switching devices are either n-type MOS TFT's or p-type MOS TFT's.

An apparatus for driving an organic electro-luminescence device according to another aspect of the present invention includes an electro-luminescence display panel having m×n number of electro-luminescence pixel devices at intersections of m number of row lines and n number of column lines; a data driver driving the column lines; a scan driver driving the row lines; a timing controller applying a scan control signal for driving the row lines to the scan driver and applying a column control signal together with a video data signal to the data driver; and a power supplier applying a drive voltage to the display panel, the data driver, the scan driver and the timing controller, and applying a common voltage to a cathode terminal of an electro-luminescence cell within the electro-luminescence pixel device.

An apparatus for driving an organic electro-luminescence device according to still another aspect of the present invention includes an electro-luminescence display panel having m×n number of electro-luminescence pixel devices at intersections of m number of row lines and common voltage lines and n number of column lines; a data driver driving the column lines; a scan driver driving the row lines; a common voltage driver driving the common voltage line; a timing controller applying a scan control signal for driving the row lines to the scan driver, applying a column control signal together with a video data signal to the data driver, and applying a common voltage control signal for driving the common voltage lines to the common voltage driver; and a power supplier applying a drive voltage to the display panel, the data driver, the scan driver, the common voltage driver and the timing controller, and applying a common voltage to a cathode terminal of an electro-luminescence cell within the electro-luminescence pixel device.

The driving apparatus includes a system controller controlling the timing controller and transmitting a video data from the outside; and a video supplier connected to the system controller and the power supplier for inputting the video data and applying each control signal to the system controller.

A method for driving an organic electro-luminescence device having an electro-luminescence cell and a cell drive voltage source for driving the electro-luminescence cell in response to data formed at each pixel area between a plurality of column lines supplied with the data and a plurality of row lines for selecting a scan line; and a switch selectively connecting a capacitor charged with the data from the column lines and sustaining the charged data and selectively connecting a cathode terminal of the electro-luminescence cell to a common voltage source or a ground voltage source, the method according to still another aspect of the present invention including connecting the switch to the common voltage source; applying the data to the column lines; applying a scan voltage synchronized with the data to the row lines; and switching the switch to the ground voltage source.

The step of applying the scan voltage to the row lines includes charging the capacitor with the supplied data through a switching device.

The step of switching the switch to the ground voltage source includes applying a voltage charged in the capacitor to the switching device connected between the cell drive voltage source and the electro-luminescence cell; adjusting a current path width of a source and a drain terminal of the switching device by the applied data voltage; and having the electro-luminescence cell emit light by a voltage difference between the cell drive voltage source and the ground voltage source corresponding to the applied data voltage.

In this example, the switch is switched for each ½ frame period.

In another example, the switch is switched by the asymmetric period for one frame.

These and other objects of the present application will become more readily apparent from the detailed description given hereinafter. However, it should be understood that the detailed description and specific examples, while indicating preferred embodiments of the invention, are given byway of illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
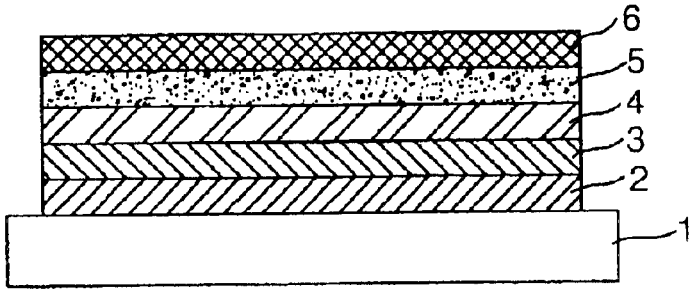
FIG.1 RELATED ART
FIG. 1 is a view briefly representing a sectional structure of an organic electro-luminescence device of the related art.
Figure 3:
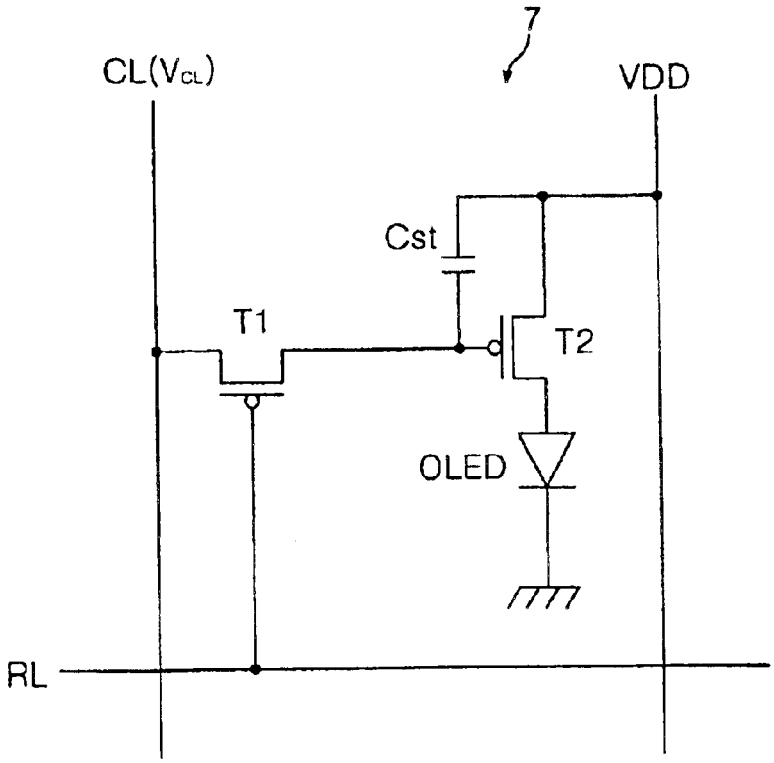
FIG.3 RELATED ART
FIG. 3 is an equivalent circuit diagram of a pixel shown in FIG. 2.
Figure 2:
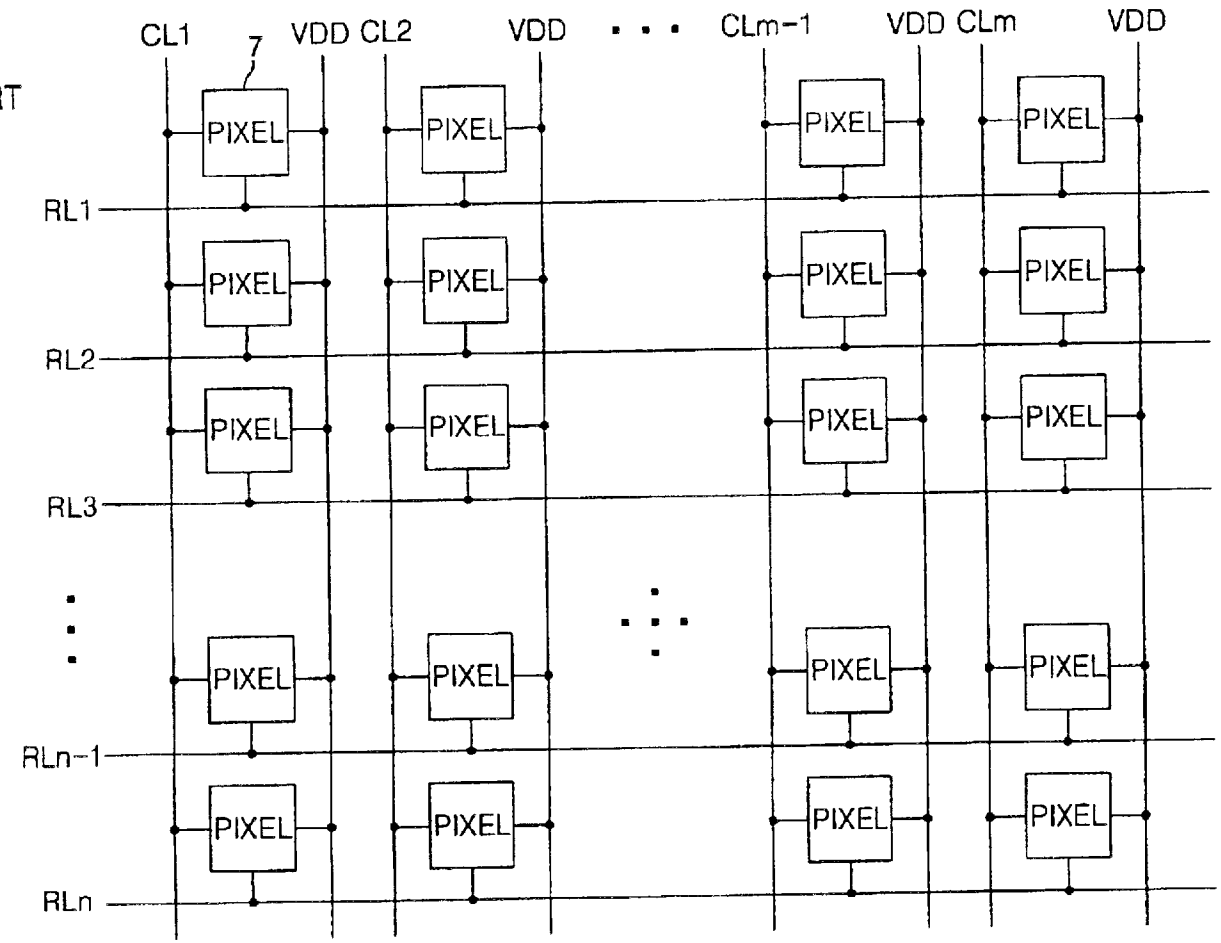
FIG.2 RELATED ART
FIG. 2 is a plan view briefly representing a pixel arrangement of an organic electro-luminescence device of the related art.
Figure 4:
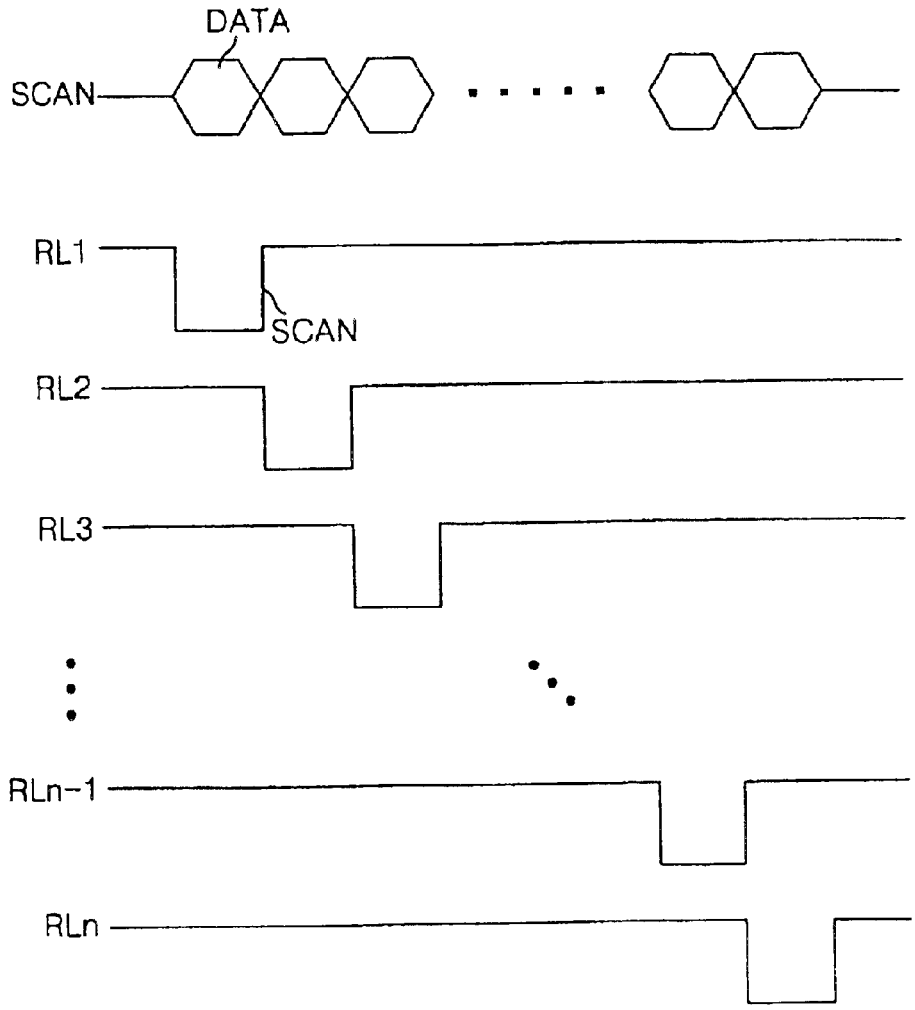
FIG. 4 RELATED ART
FIG. 4 is a waveform diagram representing signals applied to a column line and a row line shown in FIGS. 2 and 3.
Figure 5:
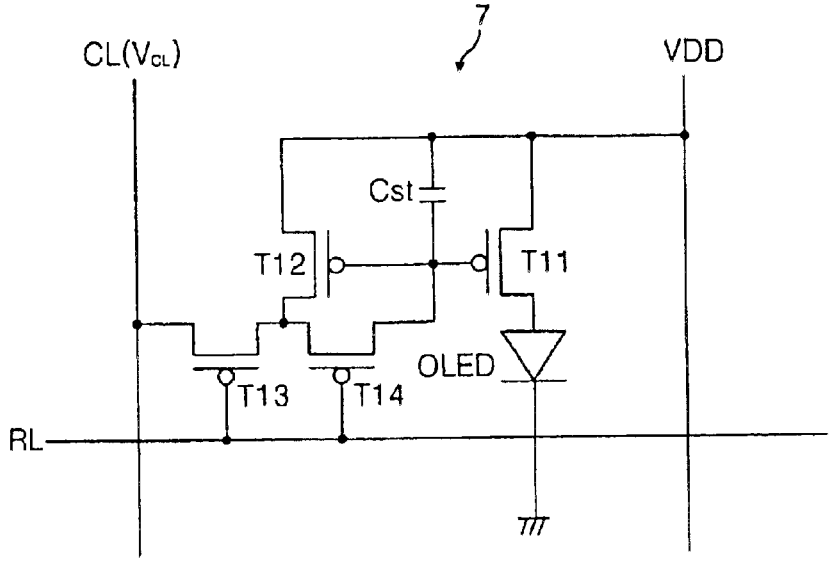
FIG.5 RELATED ART
FIG. 5 is another equivalent circuit diagram of a pixel shown in FIG. 2.
Figure 6:
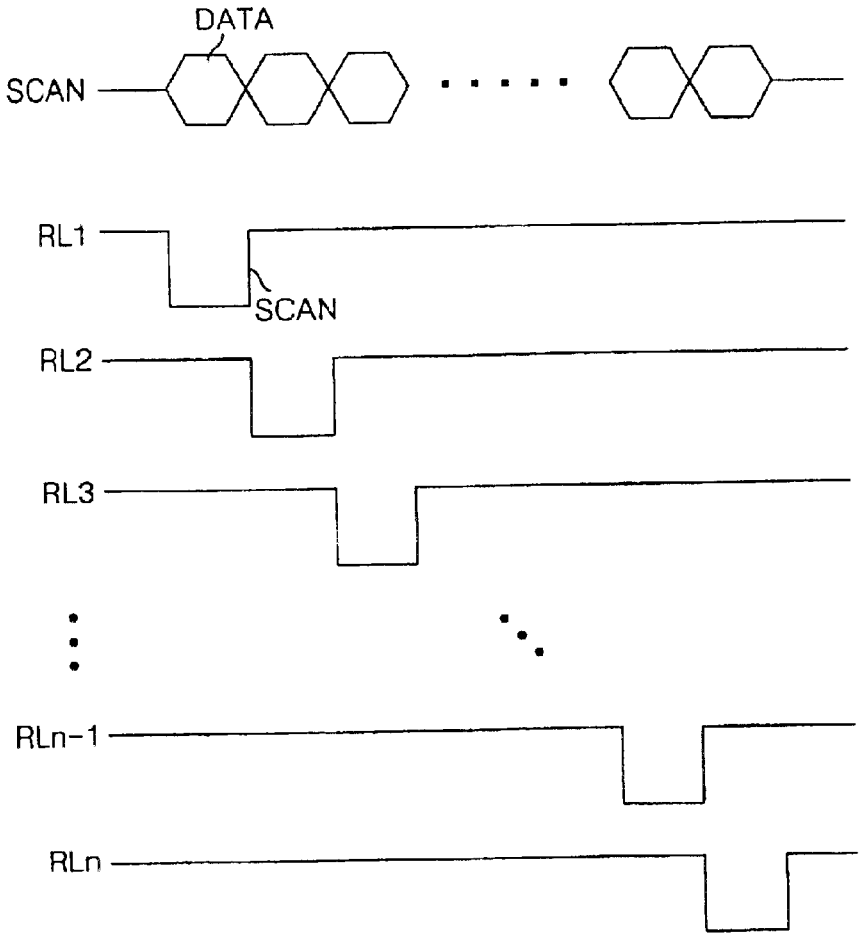
FIG.6 RELATED ART
FIG. 6 is a waveform diagram representing signals applied to a column line and a row line shown in FIGS. 2 and 5.
Figure 7:
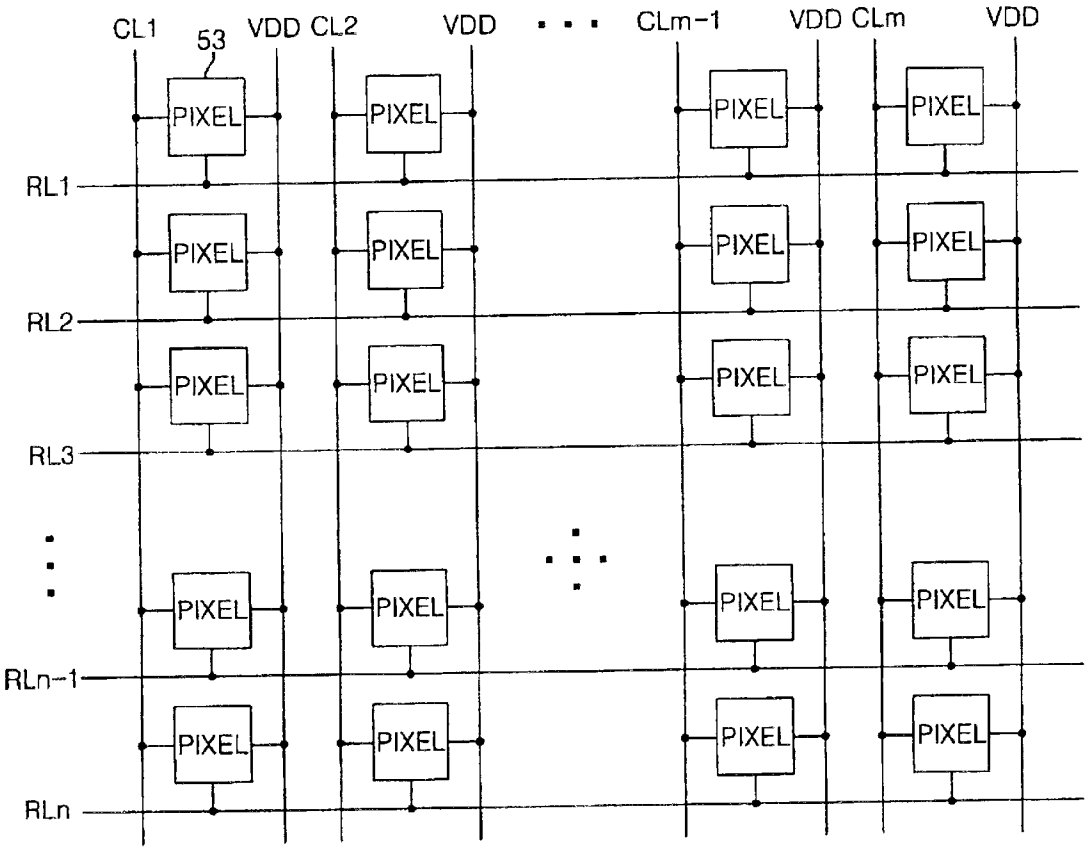
FIG. 7 is a plan view briefly representing a pixel arrangement of an organic electro-luminescence device according to an embodiment of the present invention.
Figure 8:
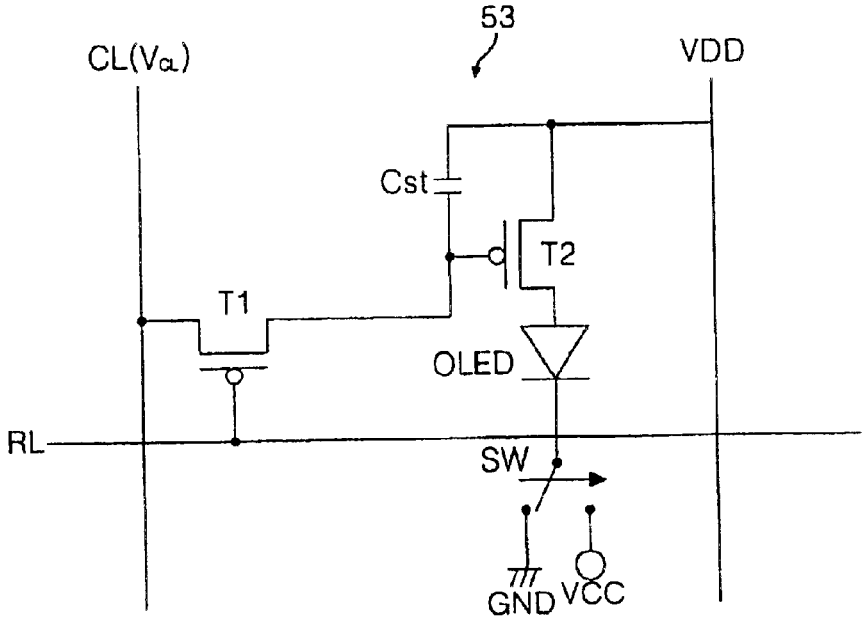
FIG. 8 is a pixel circuit diagram of the organic electro-luminescence device shown in FIG. 7.

FIG. 7 is a plan view briefly representing a pixel arrangement of an organic electro-luminescence device according to an embodiment of the present invention. FIG. 8 is a pixel equivalent circuit diagram of the organic electro-luminescence device shown in FIG. 7, and FIG. 9 is another pixel equivalent circuit diagram of the organic electro-luminescence device shown in FIG. 7.

Figure 9:
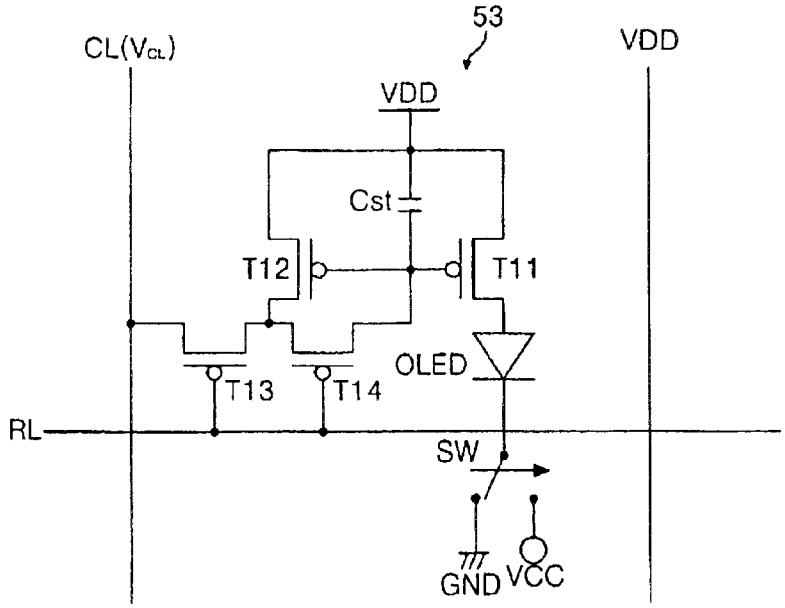
FIG. 9 is another pixel circuit diagram of the organic electro-luminescence device shown in FIG. 7.

Referring to FIGS. 7 to 9, the organic electro-luminescence device according to the embodiment of the present invention includes m number of column lines CL1 to CLm, n number of row lines RL1 to RLn, and m×n number of pixels Pixels (53) arranged in a matrix having the column lines CL1 to CLm cross the row lines RL1 to RLn.

In one example, the organic EL device, as shown in FIG. 8, includes for each pixel 53 a first TFT T1 formed at each intersection area of the column lines CL1 to CLm and the row lines RL1 to RLn to act as a switching device, a second TFT T2 formed between an electro-luminescence cell OELD, a cell drive voltage source VDD and a common voltage source (or cathode voltage source) VCC for driving the electro-luminescence cell OELD, a capacitor Cst connected between the first and second TFT's T1 and T2, and a switch SW selectively connecting the cathode terminal of the electro-luminescence cell OLED to either the common voltage source VCC or a ground voltage source GND. The first and second TFT's T1 and T2 can be p-type MOS-FETs, n-type MOS-FFTs (with the pixel structure reversed), or other suitable switching devices.

The first TFT T1 is turned on in response to a negative scan voltage from the corresponding row line RL to make a current path conduct electricity between the source terminal and the drain terminal of itself, and is sustained at an off-state when the voltage in the row line RL is lower than its threshold voltage Vth. While the first TFT T1 remains at its on-state, the data voltage $V_{CL}$ from the corresponding column line CL is applied to the gate terminal of the second TFT T2 through the source terminal and the gate terminal of the first TFT T1. Contrary to this, the current path between the source terminal and the drain terminal of the first TFT T1 is open during the off period of the first TFT T1, so the data voltage $V_{CL}$ is not applied to the second TFT T2.

The second TFT T2 controls the current between the source terminal and the drain terminal in accordance with the data voltage $V_{CL}$ applied to its gate terminal to cause the electro-luminescence cell OLED to emit light in a brightness corresponding to the data voltage $V_{CL}$.

The capacitor Cst stores a difference voltage between the data voltage $V_{CL}$ and the cell drive voltage VDD to cause the voltage applied to the gate terminal of the second TFT T2 to be sustained uniformly for one frame period and at the same time to sustain the current applied to the electro-luminescence OLED uniformly for one frame period.

The switch SW switches between the common voltage source VCC and the ground voltage source GND to alternately apply the current to the electro-luminescence cell OLED in a forward direction GND (by selecting the GND) or a reverse direction VCC (by selecting the VCC). The electro-luminescence cell OLED is non-luminous when the switch SW selects the common voltage source VCC. While not being luminous, data are applied to the capacitor Cst and pixel data are applied to the entire panel. When the switch SW selects the ground voltage source GND, the electro-luminescence cell OLED becomes luminous by emiting light in a brightness corresponding to the pixel data voltage $V_{CL}$ stored while not being luminous.

In another example, each pixel 53 in the organic EL device of FIG. 7 has a configuration shown in FIG. 9. Such an organic EL device includes for each pixel 53 a first TFT T11 formed between the cell drive voltage source VDD and the electro-luminescence cell OLED to drive the electro-luminescence cell OLED; a second TFT T12 connected to the cell drive voltage source VDD to form a current mirror with the first TFT T11; a third TFT T13 connected to the second TFT T12, the corresponding column line CL and the corresponding row line RL to respond to the signal in the row line RL; a fourth TFT T14 connected between the gate terminals of the first TFT T11 and the second TFT T12, the row line RL and the third TFT T13; a capacitor Cst connected between the gate terminals of the first TFT T11 and the second TFT T12 and the voltage supply line VDD; and a switch SW selectively connecting the cathode terminal of the electro-luminescence cell OLED to either the common voltage source (cathode voltage source) VCC or the ground voltage source GND. The first to fourth TFT's T11 to T14 can be p-type MOS-FETs, n-type MOS-FETs (with the pixel structure reversed), or other suitable switching devices.

The third and fourth TFT's T13 and T14 are turned on in response to a negative scan voltage from the corresponding row line RL to make a current path conduct electricity between their source terminal and the drain terminal, and are sustained at an off-state when the voltage in the row line RL is lower than their threshold voltage Vth. While the third and fourth TFT's T13 and T14 remain at their on-state, the data voltage $V_{CL}$ from the corresponding column line CL is applied to the gate terminal of the first TFT T11 through the third and fourth TFT's T13 and T14. Contrary to this, the current paths between the source terminal and the drain terminal of the first and second TFT's T11 and T12 are open during the off-period of the first and second TFT's T11 and T12, so the data voltage $V_{CL}$ is not applied to the first TFT T11.

The first TFT T11 controls the current between the source terminal and the drain terminal in accordance with the data voltage $V_{CL}$ applied to its gate terminal to cause the electro-luminescence cell OLED to emit light in a brightness corresponding to the data voltage $V_{CL}$.

The second TFT T12 is configured in a current mirror form with the first TFT T11 to control the current from the first TFT T11 uniformly.

The capacitor Cst stores a difference voltage between the data voltage $V_{CL}$ and the cell drive voltage VDD to cause the voltage applied to the gate terminal of the first TFT T11 to be sustained uniformly for one frame period and at the same time to sustain the current applied to the electro-luminescence OLED uniformly for one frame period.

The switch SW switches between the common voltage source VCC and the ground voltage source GND to alternately apply the current to the electro-luminescence cell OLED in a forward direction GND (by selecting the GND) or a reverse direction VCC (by selecting the VCC). The electro-luminescence cell OLED is non-luminous when the switch SW selects the common voltage source VCC. While not being luminous, data are applied to the capacitor Cst and pixel data are applied to the entire panel. When the switch SW selects the ground voltage source GND, the electro-luminescence cell OLED becomes luminous by emitting light in a brightness corresponding to the pixel data voltage $V_{CL}$ stored while not being luminous.

Figure 10:
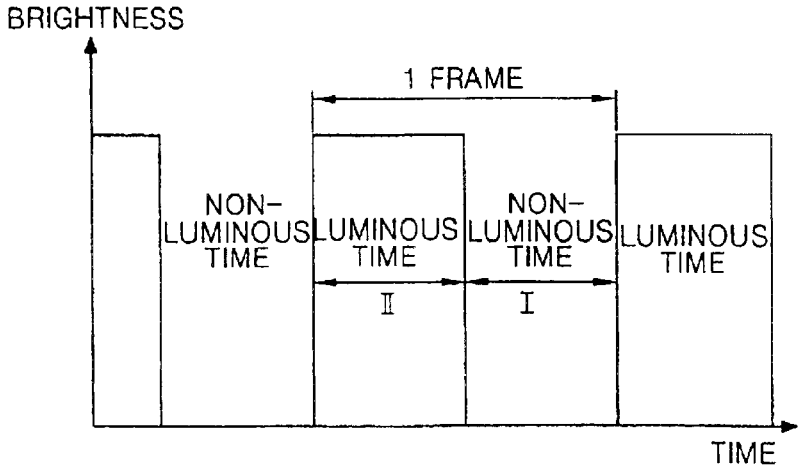
FIG. 10 is a diagram briefly representing the concept of light-emission for driving an organic electro-luminescence device according to an embodiment of the present invention.
Figure 11:
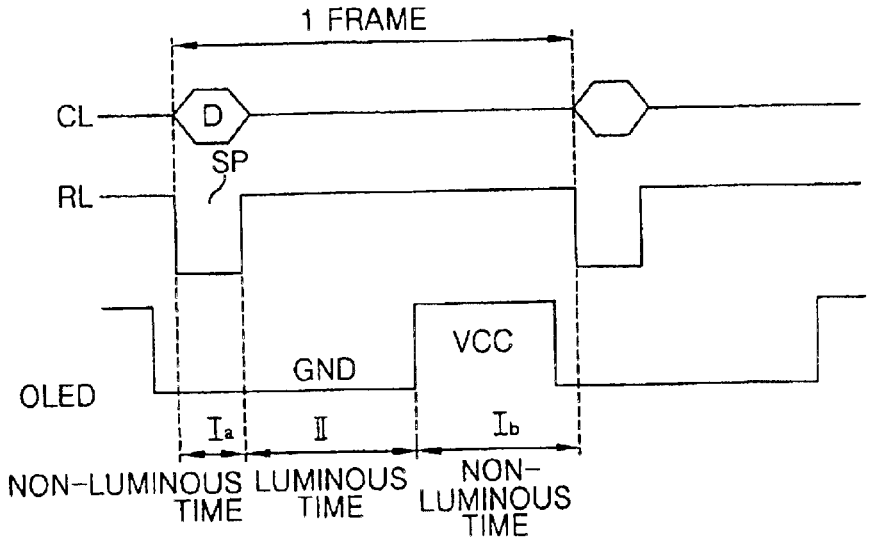
FIG. 11 is a diagram representing an example of an actual drive waveform applicable to the device of FIG. 7.

FIG. 10 is a diagram briefly representing the concept of light-emission for driving an organic electro-luminescence device according to an embodiment of the present invention. FIG. 11 is a diagram representing an example of an actual drive waveform applicable to the device FIG. 7, and FIG. 12 is a diagram representing another example of an actual drive waveform applicable to the device of FIG. 7.

Figure 12:
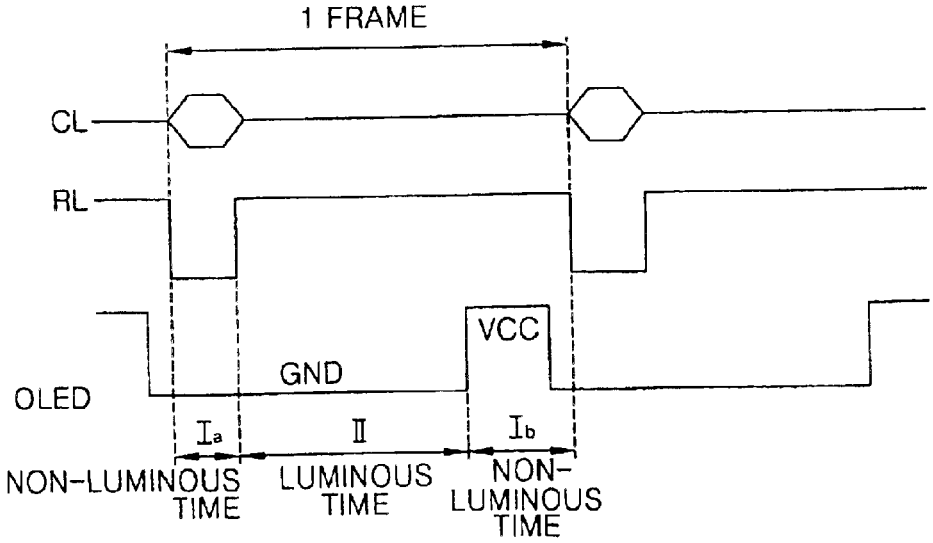
FIG. 12 is a diagram representing another example of an actual drive waveform applicable to the device of FIG. 7.

Referring to FIGS. 10 to 12, the organic electro-luminescence device according to the present invention has non-luminous time (I) and luminous time (II) in one frame period (e.g., 16.67 ms).

The non-luminous time (I) includes a time (Ia) when a drive signal is applied to the row line RL and the column line CL and a time (Ib) when the data signal from the column line CL is charged in the capacitor Cst and sustained after the drive signal being applied. At this moment, the cathode terminal of the electro-luminescence cell OLED is connected to the common voltage source VCC to have a designated common voltage VCC flow in it. The common voltage source VCC is applied to the cathode terminal of the electro-luminescence cell OLED before the scan signal and the data signal is applied to the row line RL and the column line CL.

The luminous time (II) is a time when the data voltage stored at the capacitor Cst causes the current between the source terminal and the drain terminal of the TFT connected to the electro-luminescence cell OLED to be controlled to make the electro-luminescence cell OLED luminous with the cell drive voltage source VDD corresponding to the data voltage. At this moment, the cathode terminal of the electro-luminescence cell OLED is connected to the ground voltage source GND and before the luminous time (II) expires, the electro-luminescence cell OLED is connected to the common voltage source VCC through the switch SW.

As can be seen through the above configuration, the electro-luminescence cell OLED according to the present invention is driven with the luminous time (I) and the non-luminous time (II) alternately changed. Through this, motion blurring can be reduced significantly and the picture quality of a motion picture can be improved greatly. And, the contrast effect of light and shade is expressed clearly when being driven according to the present invention, thus the contrast can be improved. This configuration also overcomes the problems of the related art discussed above.

In the present invention, an applied voltage of the common voltage source VCC should have a voltage size as in Formula 1.

$$VCC>[(VDD-Vth1)+Vth2] \quad \text{[Formula 1]}$$

Herein, VCC is a voltage applied to the cathode electrode of the electro-luminescence cell OLED, VDD is the cell drive voltage, Vth1 is the threshold voltage of T1 of FIG. 8 and T12 of FIG. 9, and Vth2 is the threshold voltage of the electro-luminescence cell OLED.

Hereby, the common voltage VCC should be set to be higher than a voltage obtained by adding the second threshold voltage Vth2 after subtracting the first threshold voltage Vth1 from the cell drive voltage VDD to be applied.

Further, the luminous time (II) can be controlled as in FIGS. 11 and 12 in proportion to the connection time of the ground voltage source GND, which are applied to the cathode terminal of the electro-luminescence cell OLED.

Figure 13:
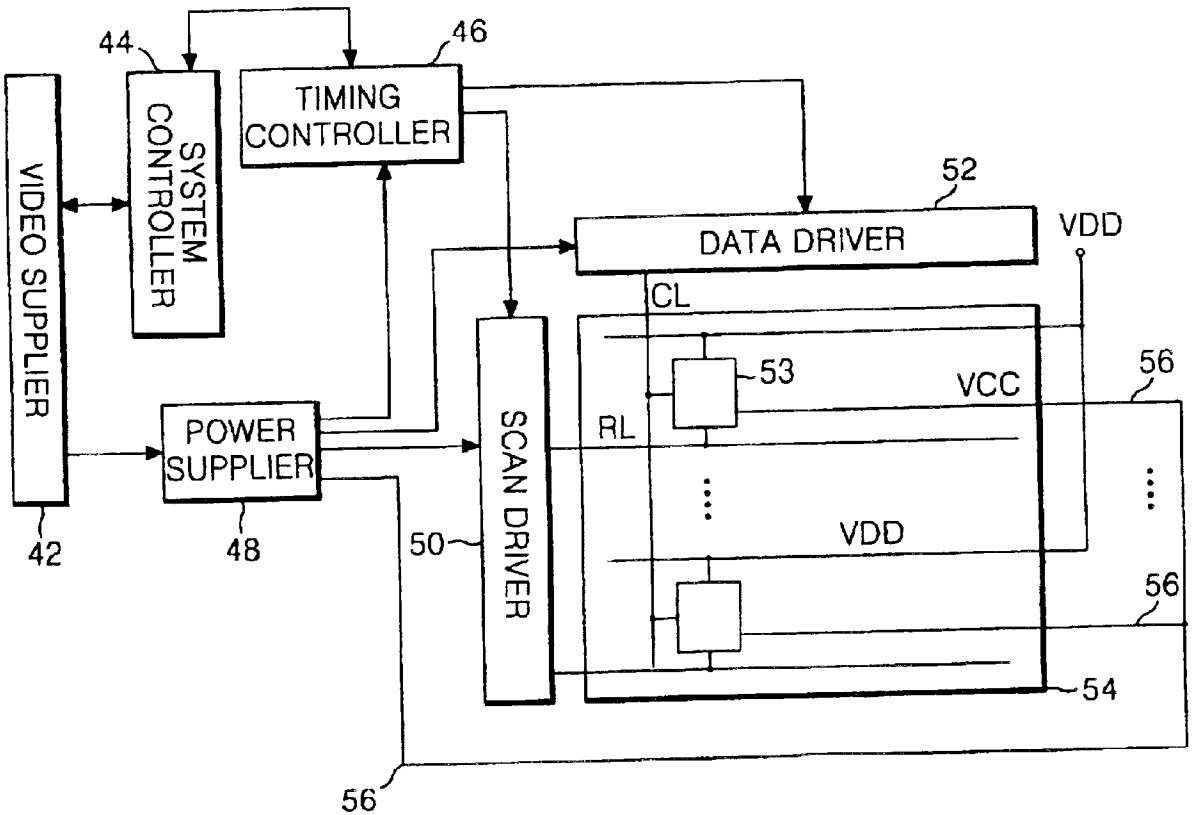
FIG. 13 is a block diagram briefly illustrating a drive apparatus for driving an organic electro-luminescence device according to an embodiment of the present invention.

FIG. 13 is a block diagram briefly illustrating a drive apparatus for driving an organic electro-luminescence device according to an embodiment of the present invention.

Referring to FIG. 13, the driving apparatus of the organic electro-luminescence device drives an organic electro-luminescence device 54 having pixels 53 each arranged at each intersection area of row lines RL and column lines CL. The organic EL device 54 can be the organic EL devices shown in FIGS. 7, 8 and 9, or can be other type of organic EL device. The driving apparatus includes a scan driver 50 driving the row lines RL of the organic electro-luminescence device 54; a data driver 52 driving the column lines CL of the organic electro-luminescence device 54; a timing controller 46 controlling the scan driver 50 and the data driver 52; and a power supplier 48 applying a drive power to the driving apparatus, all operatively coupled. Further, the driving apparatus of the organic electro-luminescence device further includes a system controller 44 controlling the timing controller 46, and a video supplier 42 controlling the drive of the system controller 44 and the power supplier 48 and inputting video data information, all operatively coupled.

Each pixel 53 is driven when the scan signals of the corresponding row line RL is enabled, to generate light corresponding to the size of the video signal in the corresponding column line CL. Each pixel 53 is configured as illustrated in FIG. 8 or 9, and the cathode terminal of each electro-luminescence cell OLED is selectively connected to either the common voltage source VCC and the ground voltage source GND through the switch SW. Due to this feature, the luminous time of the electro-luminescence cell OLED is controlled.

The timing controller 46 applies a scan control signal to the scan driver 50 for controlling the row lines RL and at the same time applies control signals along with data to the data driver 52.

The scan driver 50 applies a scan pulse, which enables the row lines RL sequentially, in accordance with the scan control signal from the timing controller 46.

The data driver 52 applies a data signal from the timing controller 46 to the pixels 53 through the column lines CL in response to the control signals applied from the timing controller 46. In this case, the data driver 52 applies the data to the column lines CL by horizontal lines for each scan period when the scan driver 50 drives each row line RL.

The power supplier 48 applies a drive power to the timing controller 46, the scan driver 50, the data driver 52 and the organic electro-luminescence device 54. Specifically, the power supplier 48 applies the common voltage VCC to the cathode terminals of the electro-luminescence cells OLEDs through the common voltage lines 56. That is, in this embodiment, the power supplier 48 applies the common voltage VCC to the entire panel (i.e., to all the OLEDs) simultaneously through the common voltage lines 56.

Figure 14:
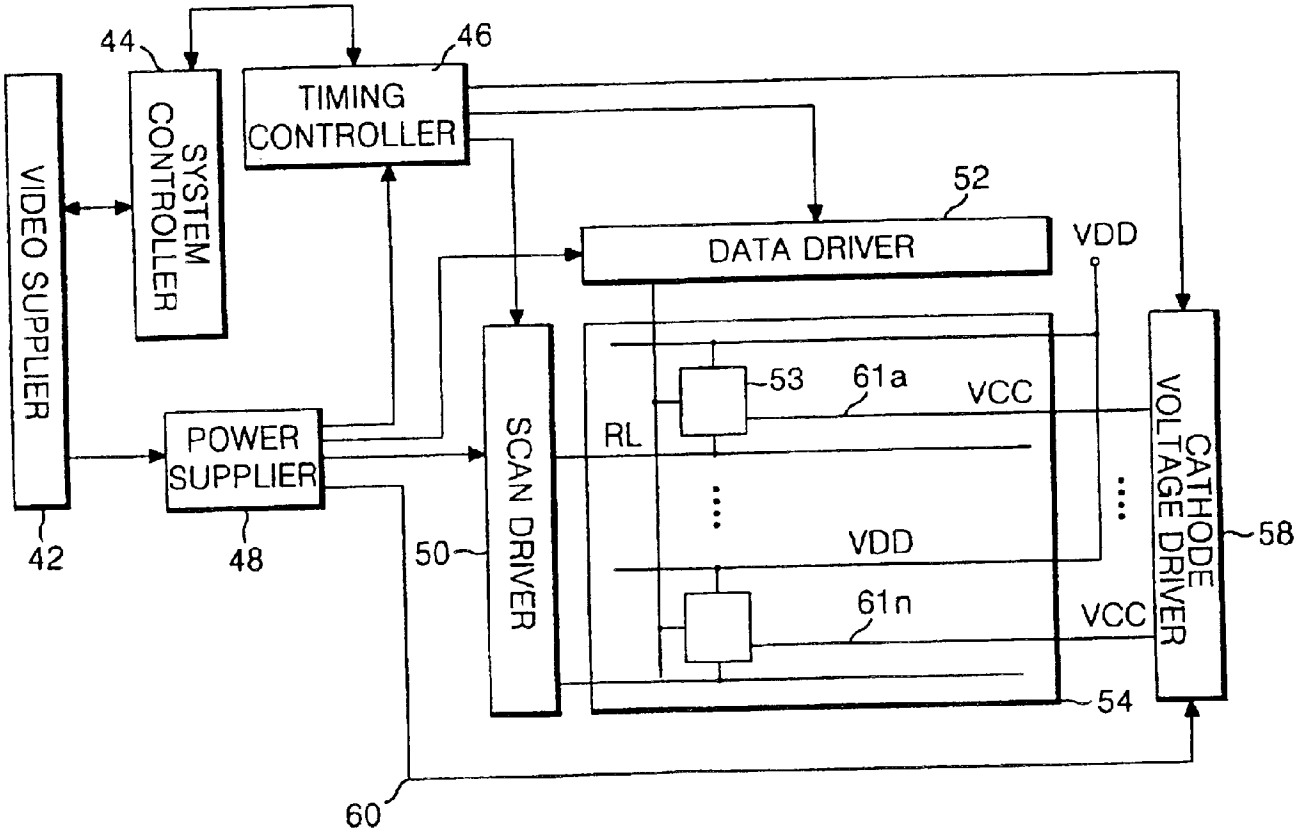
FIG. 14 is a block diagram briefly illustrating a drive apparatus for driving an organic electro-luminescence device according to another embodiment of the present invention.

FIG. 14 is a block diagram briefly illustrating another example of the drive apparatus for driving the organic electro-luminescence device according to another embodiment of the present invention.

Referring to FIG. 14, the driving apparatus of the organic electro-luminescence device according to another embodiment of the present invention has the same elements (identified by the same reference numerals) as the driving apparatus of FIG. 13, except that the common voltage VCC is selectively applicable to the cathode terminal of each separate electro-luminescence within the organic electro-luminescence device.

To accomplish this, the driving apparatus includes a common voltage driver (cathode voltage driver) 58 for selectively driving the common voltage VCC. Further, the timing controller 46 further supplies a control signal to the common voltage driver 58 to control the common voltage driver 58. Particularly, the power supplier 48 supplies the common voltage (cathode voltage) VCC to the common voltage driver 58 via a common line 60. Then the common voltage driver 58 selectively applies the common voltage VCC to each VCC line 61*a*–61*n* under the control signal(s) from the timing controller 46. The common voltage driver 58 may include one or more switches to accomplish this (e.g., one switch per row). The timing controller 46 can generate and send the control signal(s) to the common voltage driver 58 to selectively (or sequentially) apply the common voltage VCC to each pixel 53 as needed based on the operation of the pixels 53. In this example, each of the VCC lines 61*a*–61*n* would supply the common voltage VCC to all the cathode terminals of the OLEDs of the pixels 53 in one row.

Since all other components of the device shown in FIG. 14 operate in the same manner as the device shown in FIG. 13, the description thereof will be omitted.

As described above, the organic electro-luminescence device and the method and apparatus for driving the same according to the embodiment of the present invention has the cathode terminal of the electro-luminescence cell OLED configured to be selectively connected to the common voltage source VCC and the ground voltage source GND. Because of this feature, the current is alternately applied to the electro-luminescence cell of the organic electro-luminescence device in a forward direction or a reverse direction. This eliminates any build-up of residential currents in the OLEDs, whereby the lifetime, effectiveness and reliability of the electro-luminescence cells and the picture quality of the motion picture are improved significantly.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic electro-luminescence device comprising:

a plurality of column lines supplied with data;

a plurality of row lines crossing the column lines for selecting a scan line;

at least one electro-luminescence cell each formed at a pixel area between the column lines and the row lines; and a cell drive voltage source for applying a drive voltage to the electro-luminescence cell, and wherein a cathode terminal of the electro-luminescence cell is selectively connected between a cathode voltage source and a ground voltage source to have a reverse bias voltage selectively applied to the cathode terminal, and wherein a common voltage supplied from the cathode voltage source is set to be higher than a total voltage obtained by adding a threshold voltage of the electro-luminescence cell after subtracting a threshold voltage of a switching device from a cell drive voltage of the cell drive voltage source.

2. The organic electro-luminescence device according to claim 1, further comprising:

a switch selectively connecting the cathode terminal of the electro-luminescence cell to the cathode voltage source or the ground voltage source.

3. The organic electro-luminescence device according to claim 2, wherein the switch is switched between the cathode voltage source and the ground voltage source within a designated period per frame.

4. The organic electro-luminescence device according to claim 2, wherein the switch is switched within each ½ frame period.

5. The organic electro-luminescence device according to claim 2, wherein the switch is switched at an asymmetric period point within each frame period.

6. The organic electro-luminescence device according to claim 1, further comprising:

a first switching device formed at each intersection area of the column lines and the row lines;

wherein the switching device is a second switching device formed between the electro-luminescence cell and the cell driver voltage source for driving the corresponding electro-luminescence cell; and a capacitor connected between the first and second switching devices and the cell drive voltage source.

7. The organic electro-luminescence device according to claim 6, wherein the first and second switching devices are thin film transistors.

8. The organic electro-luminescence device according to claim 7, wherein the first and second switching devices are MOS TFT's.

9. The organic electro-luminescence device according to claim 8, wherein the first and second switching devices are either n-type MOS TFT's or p-type MOS TFT's.

10. The organic electro-luminescence device according to claim 1, further comprising:

a first switching device formed at each intersection area of the column lines and the row lines and connected between the cell drive voltage source and the corresponding electro-luminescence cell;

wherein the switching device is a second switching device forming a current mirror with the first switching device and connected to the cell driver voltage source;

a third switching device connected to the second switching device, the corresponding column line and the corresponding row line for responding to a data signal in the corresponding row line;

a fourth switching device connected to the second and third switching devices and the row line; and a capacitor connected between the first and second switching devices and the cell drive voltage source.

11. The organic electro-luminescence device according to claim 10, wherein the first to fourth switching devices are thin film transistors.

12. The organic electro-luminescence device according to claim 11, wherein the first to fourth switching devices are MOS TFT's.

13. The organic electro-luminescence device according to claim 12, wherein the first to fourth switching devices are either n-type MOS TFT's or p-type MOS TFT's.

14. An apparatus for driving an organic electro-luminescence device, the apparatus comprising:

an electro-luminescence display panel having m×n number of electro-luminescence pixel units at intersections of m number of row lines and n number of column lines;

a data driver driving the column lines;

a scan driver driving the row lines;

a timing controller applying a scan control signal for driving the row lines to the scan driver and applying a column control signal together with a video data signal to the data driver; and a power supplier applying a drive voltage to the display panel, the data driver, the scan driver and the timing controller, and applying a cathode voltage to a cathode terminal of an electro-luminescence cell within at least one electro-luminescence pixel unit.

15. The apparatus according to claim 14, wherein the power supplier supplies the cathode voltage to the cathode terminals of all the electro-luminescence cells in the display panel, simultaneously.

16. The apparatus according to claim 14, further comprising:

a cathode voltage driver receiving the cathode voltage from the power supplier and selectively applying the cathode voltage to one or more of the cathode terminals of the electro-luminescence cells in the display panel.

17. The apparatus according to claim 16, wherein the cathode voltage driver applies the cathode voltage to one or more of the cathode terminals in accordance with a control signal supplied by the timing controller.

18. The apparatus according to claim 16, wherein the cathode voltage driver applies the cathode voltage to all the electro-luminescence cells in one row of the display panel, simultaneously.

19. The apparatus according to claim 14, further comprising:

a system controller controlling the timing controller and transmitting a video data from an external source; and a video supplier connected to the system controller and the power supplier for inputting the video data and applying each control signal to the system controller.

20. A method for driving an organic electro-luminescence device having an electro-luminescence cell, a cell drive voltage source for driving the electro-luminescence cell in response to data formed at each pixel area between a plurality of column lines supplied with data and a plurality of row lines for selecting a scan line, and a switch selectively connecting a cathode terminal of the electro-luminescence cell to a cathode voltage source and a ground voltage source, the method comprising:

connecting the switch to the cathode voltage source;

applying the data to the column lines;

applying a scan voltage synchronized with the data to the row lines; and switching the switch to the ground voltage source;

wherein the step of applying the scan voltage to the row lines includes charging a capacitor with the supplied data through a switching device, and wherein the step of switching the switch to the ground voltage source includes applying a voltage charged in the capacitor to the switching device connected between the cell drive voltage source and the electro-luminescence cell, adjusting a current path width of a source and a drain terminal of the switching device by the applied data voltage, and causing the electro-luminescence cell to emit light by a voltage diference between the cell drive voltage source and the ground voltage source corresponding to the applied data voltage.

21. The method according to claim 20, wherein the switch is switched within each ½ frame period.

22. The method according to claim 20, wherein the switch is switched at an asymmetric period point of each frame period.

* * * * *